United States Patent [19]

Kiraly

[11] 4,067,214

[45] Jan. 10, 1978

[54] SAFETY LOCK

[76] Inventor: Franz Kiraly, Tavastgatan 1 A 11, 20500 Abo 50, Finland

[21] Appl. No.: 697,642

[22] Filed: June 18, 1976

[30] Foreign Application Priority Data

June 24, 1975 Finland ..... 751866

[51] Int. Cl.[2] ..... E05B 15/14

[52] U.S. Cl. ..... 70/366; 70/377

[58] Field of Search ..... 70/365, 366, 376, 377, 70/402, 406, 407

[56] References Cited

U.S. PATENT DOCUMENTS

| | | | |
|---|---|---|---|
| 179,887 | 7/1876 | Arnold | 70/366 |
| 1,589,256 | 6/1926 | Spruth | 70/366 |
| 2,524,339 | 10/1950 | Young | 70/366 |
| 3,548,620 | 12/1970 | Genakis | 70/366 X |
| 3,681,956 | 8/1972 | Niilola | 70/366 |
| 3,972,210 | 8/1976 | Toivonen | 70/366 |

*Primary Examiner*—Robert L. Wolfe

*Attorney, Agent, or Firm*—Ladas, Parry, Von Gehr, Goldsmith & Deschamps

[57] ABSTRACT

A safety lock of cylinder type to be operated with a key provided with a groove, the lock comprising a drum, a ,906,437 09001975lock lever and a plurality of tumbler discs. Upon inserting the key, peripheral recesses in the tumbler discs become aligned to receive the lock bar thereby enabling the drum to be rotated. The tumbler discs rest against each other or against intermediate discs possibly arranged between the tumbler discs only within a small area near the center of the discs.

4 Claims, 8 Drawing Figures

FIG. 1
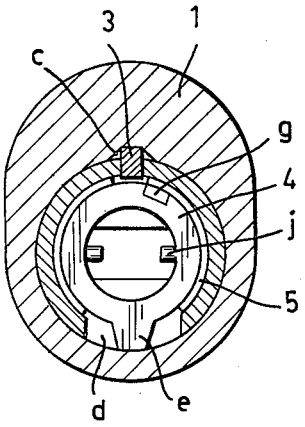
FIG. 2
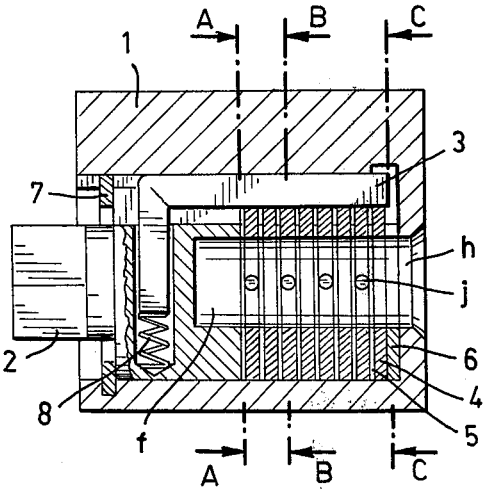
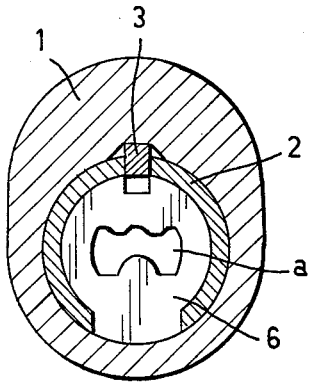
FIG. 3
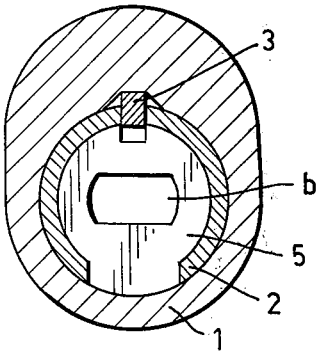
FIG. 4

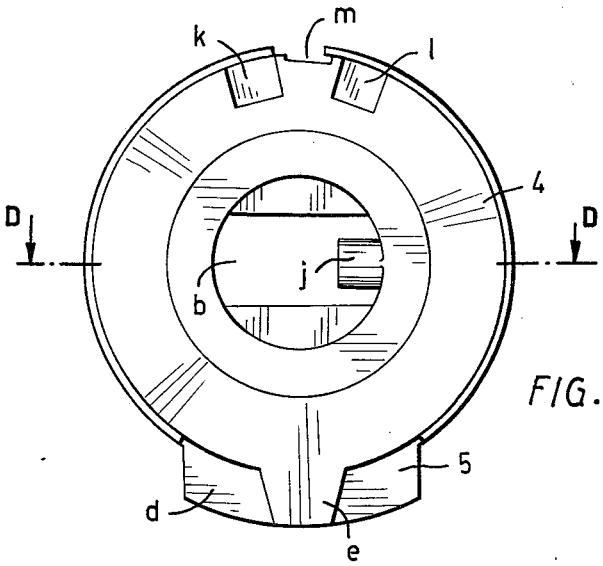
FIG. 5
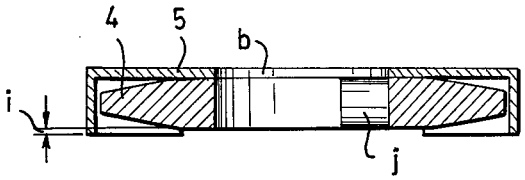
FIG. 6
FIG. 7
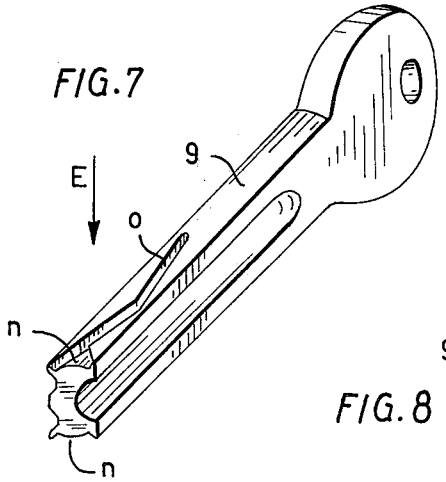
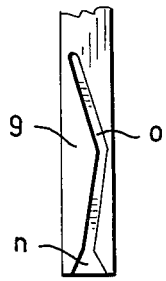
FIG. 8

SAFETY LOCK

The present invention relates to a safety lock comprising a fixed cylinder casing, a drum rotatable in the cylinder casing, a lock lever for locking and unlocking the drum, a plurality of tumbler discs rotatable with a lock key, each having on its periphery at least one recess, which recesses become aligned with each other when the key is inserted to form a groove to receive the lock lever, whereupon the drum is released so that it can be rotated, and at least one guiding device, e.g. a profile disc, for the lock key which is fixed in relation to the drum but is rotatable in relation to the cylinder casing.

Safety locks with rotatable tumbler discs have been known for a long time, and it is also known to operate the tumbler discs in such locks by means of a groove formed in the lock key, whereby the recesses in the peripheries of the tumbler discs become aligned with one another when the key is inserted in the lock. When the key is inserted in the lock, a certain axial force is applied on the locking mechanism, which force is transferred to the tumbler discs and the intermediate discs or spacers. Thus the friction between the tumbler discs and intermediate discs increases, resulting in the disc wearing and in the operation of the lock requiring considerable effort.

Attempts have been made to eliminate this friction by providing each tumbler discs with an anti-friction surface on one side or by means of arranging anti-friction intermediate discs between the tumbler discs. These solutions have, however, not produced the desired result.

It has also been suggested to provide the intermediate discs with peripheral flanges, or similar, which engage each other, so that the intermediate disc bear the major part of the axial loads exerted on the lock device, and, consequently, each individual tumbler disc only requires as much force as is necessary to move its own mass.

However, it has proved that even the latter construction is not satisfactory, since the friction, between each individual tumbler disc and corresponding intermediate disc, despite the fact that the edge flanges of the intermediate discs bear the major part of the axial forces, is so considerable that such a lock in practice is nevertheless difficult to operate.

The object of the present invention is to eliminate these disadvantages caused by the friction between the discs. The safety lock according to the invention is characterized by tumbler discs which are of such form that they touch each other, or possibly the imtermediate discs which may be arranged between the tumbler discs, only over a comparatively small area near the central opening of the discs.

By means of this form of the tumbler discs, the torque which is caused by friction and which resists the turning force, will be so insignificant, that it is easily overcome when turning the lock key. In previous constructions where the tumbler discs have been plane, the counteracting torque caused by friction at the periphery of the disc is so considerable that even when the axial forces resulting from inserting the key have been largely eliminated, turning the key still requires an excessive force.

If a lock having imtermediate discs provided with peripheral flanges is used, the tumbler discs are dimensioned so that they do not touch the peripheral flanges of the intermediate discs. The effect of the new form of the tumbler discs is, however, so considerable that intermediate discs provided with peripheral flanges are by no means necessary but can be excluded or be replaced with simpler intermediate discs of previously known type.

By using two independent locking barrels on the two sides of the key respectively, the number of combinations obtainable with the key is not merely doubled, but the total number of combinations is the product of the number of combinations obtainable with one barrel and the number of combinations obtainable with the other barrel. On account of the extremely high number of combinations thus obtained, the safety lock can be made short which has a very favourable effect on the safety and reduces costs of production. If alternate tumbler discs are associated with the two locking barrels respectively, the manufacturing tolerances of the tumbler discs can be larger which makes it possible to manufacture the locking barrels of the key and the recesses of the tumbler discs separately. Through this separate manufacture selective lockings are easier to achieve, since the tumbler discs can be manufactured ready for assembly with several recesses. In this way it is extremely easy to produce lock systems. Also, the key profile need not absolutely correspond to the profile of the key profile. The key hole may differ considerably from the profile of the key hole, whereby the key profile only is guided with greater safety. This feature makes it possible to set up central lock systems to an extent until now unknown. The profile disc defining the key hole preferably consists of annealed material, and therefore provides additional protection against damage to the tumbler discs through mechanical force.

The safety lock according to the present invention and the advantages therewith achieved will be described further in the following with reference to the accompanying drawing.

FIG. 1 shows a diametral cross section along line B=B in FIG. 2,

FIG. 2 shows a diametral longitudinal section of the safety lock according to the invention, FIG. 3 shows a diametral cross section along the line C=C in FIG. 2, FIG. 4 shows a diametral cross section along the line A=A in FIG. 2.

FIG. 5 is a view over the position of a tumbler disc in an intermediate disc, FIG. 6 shows a cross section along the line D=D in FIG. 5, FIG. 7 is a diagrammatic view of a key for the safety lock, FIG. 8 is a view according to direction E in FIG. 7.

The reference numbers in the Figures represent the following: 1 cylinder casing, 2 drum, 3 lock lever, 4 tumbler disc, 5 intermediate disc or spacer, 6 profile disc, 7 safety device, 8 spring, 9 key, *a* profile key hole, *b* distance disc hole, *c* cylinder casing groove, *d* drum groove, *e* shoulder, *f* round key hole, *g* recess, *h* key hole, *i* clearance, *j* pin, *k* recess, *l* recess, *m* deceptive groove, *n* collecting funnel, *o* locking barrel.

Normally rotation of drum 2 to the left or right in relation to cylinder casing 1 is prevented by lock lever 3 due to the fact that lock lever 3, despite the inclined walls of the cylinder casing groove *c*, cannot be pressed further in towards the axis of the cylinder than is allowed by the tolerance between the underside of the lock lever 3 and the circular periphery of the tumbler disc 4. Since the tolerance between the lock lever and tumbler disc 4 on purpose has been made smaller than the amount by which the lock lever 3 protrudes from drum 2, no rotation can takes place. When recesses *g* in all tumbler discs 4 arranged in the cylinder casing are located directly beneath lock lever 3, lock lever 3 can be pressed down when the drum 2 is rotated, by engaging the inclined wall of the cylinder casing groove *c* so that free rotation of the drum can take place in both directions.

Spring 8 then presses lock lever 3 against cylinder casing 1. Recess *g* can assume any angular position whatsoever, within the limits imposed by the tolerance shoulder *e* has in drum groove *d*. The recesses *g* can be correctly aligned under lock lever 3 by means of locking barrel *o* formed in lock key 9, the form of said locking barrel corresponding to that of recesses *g* in the tumbler discs. Thus, the locking barrel *o* cooperates with the pins *j* of the tumbler discs to bring the recesses *g* into alignment. At the very smallest deviation of the recess *g* in but a single tumbler disc 4 in relation to lock lever 3, no rotation can come about, since lock lever 3 cannot be pressed into recess*g*.

The rotation of tumbler disc 4 in relation to drum 2 takes place by means of above mentioned locking barrels *o*, in which pins *j* engage. When the key is completely inserted in the cylinder lock, recesses *g* correspond, as mentioned above, with pins *j* so that lock lever 3 can be pressed into the groove formed by the aligned recesses *g*. In order to ensure that the key 9 is always inserted in drum 2 in the same position, the position of profile disc 6 is fixed in drum 2. Furthermore, key 9 is inserted accurately in drum 2 through the guidance of the distance disc hole *b* and the round key hole *f*.

Since tumbler discs 4 have a limited freedom of rotation in drum 2 and pins *j* therefore will not always assume a fixed position in the cylinder casing, key 9 must at its front end be provided with a collecting funnel *n*, the collecting capacity of which must be at least so big that pins *j* can move within the limits imposed by the freedom of the shoulder *e* to move in drum groove *d*.

As is shown by FIG. 6, the tumbler discs are of such form that they rest against the intermediate discs 5 only within a small area near the key hole. On account of this friction the torque will be so insignificant that the discs easily can be rotated. In the illustrated embodiment the intermediate discs are provided with peripheral flanges and, of course, the tumbler disc 4 should not touch the peripheral flanges of the intermediate disc. In FIG. 6 the tumbler disc 4 tapers evenly towards the periphery, but the same result can naturally be obtained through other embodiments, e.g. with an annular elevated step near the key hole.

The invention has here been described in connection with a lock construction having intermediate discs 5 provided with peripheral flanges. Such intermediate discs are, however, by no means necessary, but a totally satisfactory function will be obtainable even without them. Alternatively, intermediate discs of previously known construction be used.

In order to prevent the safety lock from being picked by Hobbs' pick method, tumbler discs 4 are provided with so called deceptive grooves *m*. These deceptive grooves *m* prevent, in addition, acoustic picking of the safety lock variant in question. Since intermediate discs 5 are not elastic, it is not possible to compress the disc pack in order to reach the locking means, such as e.g. lock lever 3 and recesses *g*, using special tools. The small entrance cross section of profile key hole as well as the non-springing disc pack also prevent optic picking with electric observation instruments. Since the locking mechanism according to the invention is effectively protected against all these known picking methods, it can be considered to constitute an extremely reliable lock.

In addition, the profile of key 9 can be made according to mathematical methods and because the profile surface is relatively big, also so many profile variations are possible that it is almost impossible in practice to make use of all variants.

The structure of the safety lock shown in the accompanying drawings corresponds to that of a typical safety lock for outer doors. The features mentioned in the claims for the lock mechanism according to the invention can also be employed, either separately or combined, for the realization of other embodiments.

What I claim is:

1. A safety lock comprising a cylinder casing;

a drum rotatable in the cylinder casing;

a lock lever for locking and unlocking the drum;

a plurality of discs positioned in a stack within the cylinder casing, at least some of which discs are tumbler discs rotatable with a lock key, each such tumbler disc having on its periphery at least one recess which recesses are aligned with each other when the key is inserted in the lock to form a groove to receive the lock lever whereupon the drum is unlocked;

at least one key guiding element fixed in relation to the drum but rotatable in relation to the cylinder casing; and said tumbler discs being of such configuration that each tumbler disc contacts an adjacent disc of the stack only over a relatively small area near the center of the discs.

2. A safety lock according to claim 1, wherein the tumbler discs are evenly tapering towards the periphery.

3. A safety lock according to claim 1, wherein the stack of discs includes at least one intermediate disc arranged between two adjacent tumbler discs, said two adjacent tumbler discs contacting the intermediate disc only over a relatively small area near the center of the discs.

4. A safety lock according to claim 3, wherein the intermediate disc is provided with a peripheral flange which at least partially surroundds at least one of said two adjacent tumbler discs, there being a clearance between the periphery of said one tumbler disc and the interior of said peripheral flange.

* * * * *